United States Patent [19]

Farrell

[11] 4,125,903

[45] Nov. 21, 1978

[54] BABY BLANKET

[76] Inventor: Weyma B. Farrell, Box 392, Pittsboro, N.C. 27312

[21] Appl. No.: 833,510

[22] Filed: Sep. 15, 1977

[51] Int. Cl.[2] ..... A41B 9/00; A47G 9/00

[52] U.S. Cl. ..... 2/69.5; 5/334 R; 5/343

[58] Field of Search ..... 2/69, 69.5; 5/334 R, 5/343

[56] References Cited

U.S. PATENT DOCUMENTS

| | | | |
|---|---|---|---|
| 2,105,787 | 1/1938 | Herpich | 5/334 R |
| 2,832,967 | 5/1958 | Sobel | 5/343 |
| 3,034,132 | 5/1962 | Landsberger et al. | 2/69.5 |
| 3,774,249 | 11/1973 | Ibarra et al. | 5/334 R |

*Primary Examiner*—Casmir A. Nunberg
*Attorney, Agent, or Firm*—Mills & Coats

[57] ABSTRACT

The present invention relates to a baby blanket having a rectangularly shaped back and a triangularly shaped front cloth panel secured to said back adjacent approximately one-half the area of said back so as to define a baby receiving and holding compartment between said back and said triangularly shaped cloth panel. In one embodiment of the present invention, a storage compartment may be formed on either or both sides of the formed baby receiving compartment for storing baby supplies and paraphernalia.

5 Claims, 4 Drawing Figures

BABY BLANKET

The present invention relates to blankets, and more particularly to a baby blanket having a baby receiving compartment defined therein.

BACKGROUND OF THE INVENTION

Traditionally, baby blankets have been of the sheet or single layer or quilt type. As used, the blanket is open or spreaded and the baby is laid therein. After this, portions of the blanket are wrapped around the baby and the baby is confined therein in a warm and cozy environment. However, wrapping and closing a baby in a blanket in this manner does often require time and effort, and is in fact sometimes awkward and inconvenient. This is particularly true since the individual has to enclose the baby by wrapping the blanket in a random manner about the baby. Moreover, it is sometimes easy for the baby to wiggle and cause the blanket to come unwrapped from the body.

SUMMARY OF THE INVENTION

The present invention presents a baby blanket with a baby receiving and holding compartment already formed therein such that in use the baby can be easily and conveniently slipped within the defined compartment of the blanket without requiring the blanket to be wrapped around the baby as is done with conventional single layer or quilted blankets. In particularly, the baby blanket of the present invention includes a rectangularly shaped cloth or fabric back and a triangularly shaped enclosable cloth secured to approximately one-half the area of the back. The triangularly shaped enclosable cloth panel includes three edges with two edges being secured to respective sides or edges of the back and with the third edge extending diagonally across the back from opposed corners and being unsecured with respect to the back so as to define an entry area to the baby receiving and holding compartment defined between the back and the triangularly shaped enclosable cloth panel.

In one embodiment of the baby blanket of the present invention, the defined baby receiving and holding compartment can be limited by a pair of laterally spaced seams that define a storage compartment on each side of the baby receiving and holding compartment where diapers, bottles and other supplies and paraphernalia can be stored.

It is, therefore, an object of the present invention to provide an improved baby blanket that includes a baby receiving and holding compartment formed therein for receiving a baby, and thereby making it easy and convenient to cover and confine a baby within the blanket.

Still a further object of the present invention is to provide a baby blanket with a baby receiving and holding compartment therein wherein the basic construction of the entire blanket is relatively simple and inexpensive.

Another object of the present invention is to provide a baby blanket design which not only includes a baby compartment but an additional compartment or compartments for convenient storage of baby supplies and related paraphernalia.

Also an object of the present invention is to provide a baby blanket of the compartment type that is neat, easy to use, and which protects and covers a baby satisfactorily and adequately.

Other objects and advantages of the present invention will become apparent from a study of the following description and the accompanying drawings which are merely illustrative of the present invention.

Figure 1:
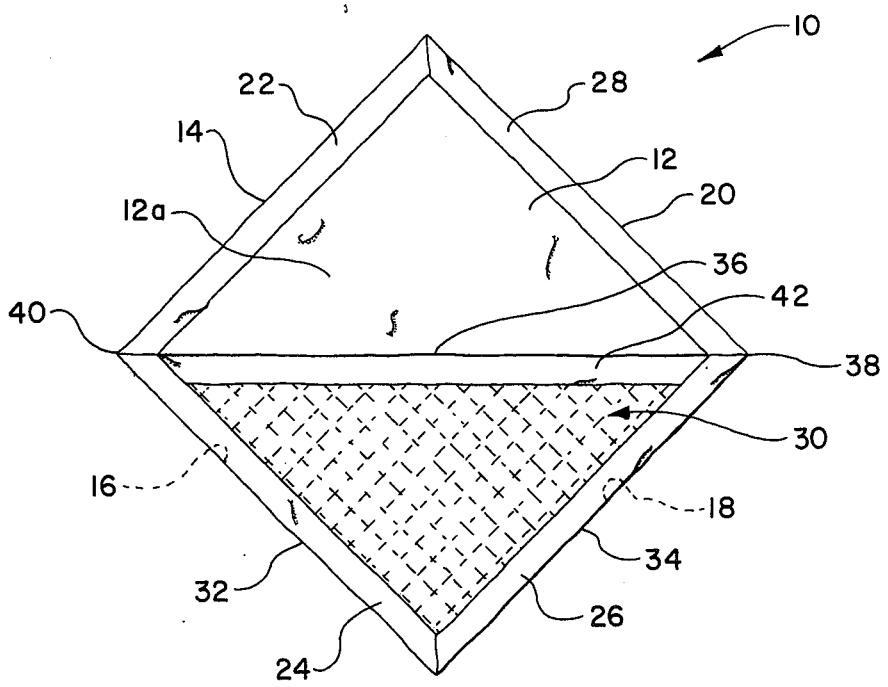
FIG. 1 is a top plan view of the front of the baby blanket of the present invention as viewed from above the blanket when spreaded horizontally over a support surface.
Figure 2:
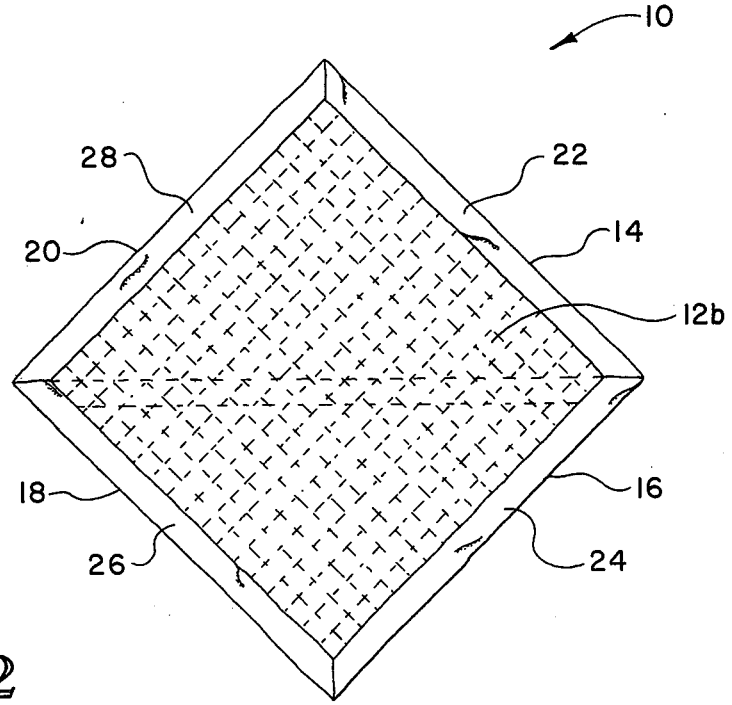
FIG. 2 is a view similar to FIG. 1 showing the rear of said baby blanket.
Figure 3:
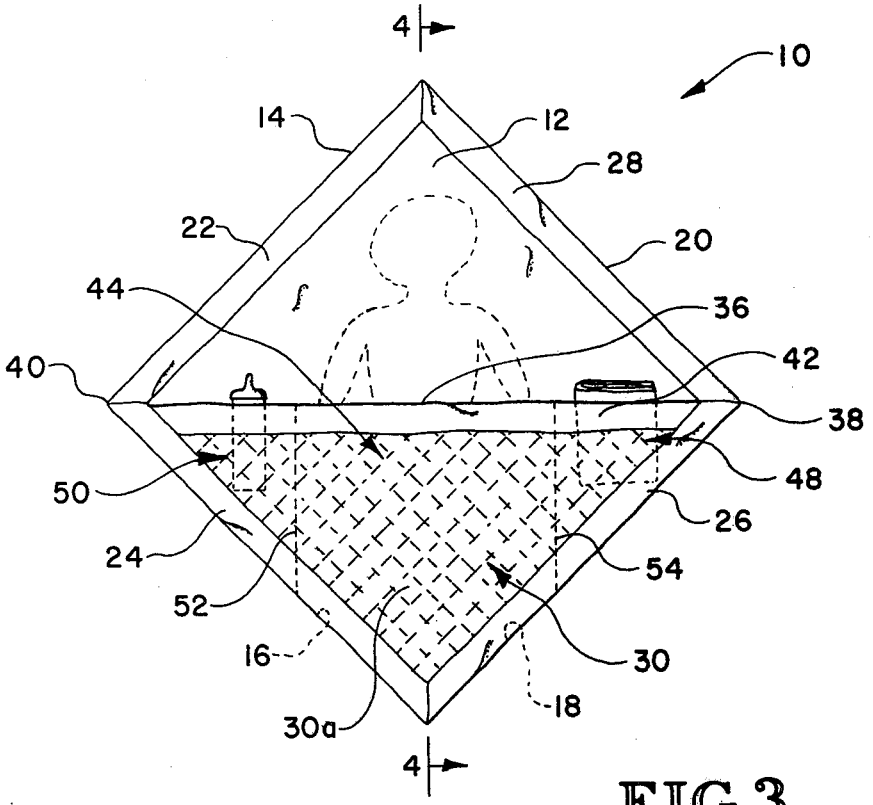
FIG. 3 is a view similar to FIG. 1 with the blanket shown therein being an alternate embodiment.
Figure 4:
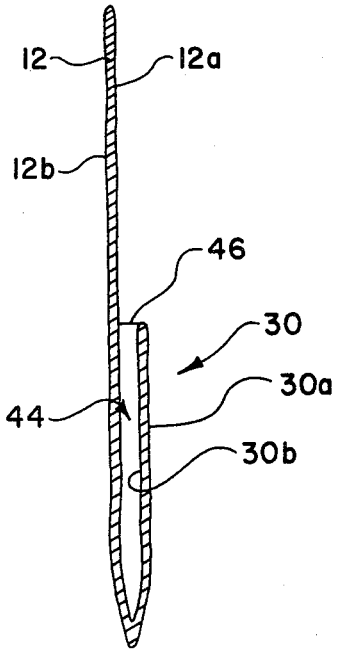
FIG. 4 is a cross sectional view taken along the lines 4—4 of FIG. 3.

With further reference to the drawings, particularly FIGS. 1-3, the baby blanket of the present invention is shown therein and indicated generally by the numeral 10. Viewing the baby blanket 10 in detail, it is seen that the same includes a generally rectangular or square back 12 that is of a cloth or fabric material preferably. The front of the back 12, as viewed in FIGS. 1 and 3, and as referred to as by **12*a*, is preferably a lightweight lining material, while the back, referred to by 12*b***, can be of a quilted cloth or fabric type construction.

Continuing to view back 12, it is seen that the same includes sides or edges 14, 16, 18 and 20. Disposed about the edges just referred to on both the front and rear of the back 12 is a bordering material 22, 24, 26 and 28, that may extend approximately one and one-half inch to two inches from the edge or side of the baby blanket or back 12.

As referred to above, the back 12 in the embodiment disclosed is of a generally square or rectangular shape. An enclosable cloth panel 30 of approximately one-half the area of the back 12 is secured to a portion of the back to form a baby compartment 44 between back 12 and the enclosable cloth panel 30. It is contemplated that the area of panel 30 could be one-third to two-thirds the area of back 12. As seen, cloth panel 30 is triangularly shaped and includes a front **30*a* that may be preferably of a quilted construction and a rear 30*b* that faces the front of the back 12*a* and this would preferably include a lightweight lining material such as that formed about the front 12*a* of the back 12**.

Cloth panel 30 being triangular in shape includes three sides or edges - 32, 34, and 36. In construction, the bordering material strips 24 and 26 is stitched about the baby blanket such that about two sides of the cloth panel that such bordering material is pulled up and around respective edges 32 and 34 of the cloth panel 30. In particularly, as disposed in the drawings, the bordering strips 24 and 26 of the baby blanket are secured about the front outer edges of sides 32 and 34 of the cloth panel 30.

Side or edge 36 of the triangular cloth panel 30 is unsecured with respect to the back 12 and extends diagonally across back 12 between corners denoted by the numeral 38 and 40. The unsecured side or edge 36 includes a like bordering silk material 42 and between the unsecured edge 36 and back 12 there is defined an entry area 46 to the underlying formed baby compartment 44.

In securing the various components of the baby blanket 10 such as the back 12, the triangular shaped cloth panel 30, and the bordering material, conventional stitches are utilized and such can be performed by conventional sewing equipment or sewing machines.

With reference to FIG. 1, it is seen that a baby can be securely held within baby blanket 10 by placing the baby into the baby compartment 44 through the defined entry area 46 that exists between the unsecured edge 36 and the back 12. After this, the baby can be further protected and covered by pulling side portions of the baby blanket around the baby in the baby compartment 44.

Turning to FIG. 2, an alternate embodiment is shown wherein in this embodiment two storage compartments 48 and 50 are defined and formed on each side of the baby compartment 44. This is accomplished by restricting the area of the baby compartment 44 by providing two laterally spaced seams 52 and 54 which connect the front triangular panel 30 with the back 12. It follows that the presence of these two seams, 52 and 54, create or form an open storage area 48 and 50 on each side of the baby compartment 44 and each of these compartments is adapted to receive baby supplies such as diapers, baby food, or bottles and any other suitable paraphernalia. It is, therefore, appreciated that the presence of the seams 52 and 54 divides the original baby compartment 44 of the species shown in FIG. 1 into three compartments with the two outer flanking compartments being referred to as storage compartments while the compartment between seams 52 and 54 remains the baby compartment 44.

From the foregoing specification, it is seen that the baby blanket 10 of the present invention presents a blanket structure that is particularly adapted to protect and cover infants and which is especially designed to include an already formed baby receiving and holding compartment 44. It follows that a baby or infant can easily and conveniently be placed within the compartment and the protection and cover desired can be afforded the baby or infant without having to wrap and manipulate a single layer blanket about the baby. Moreover, the design of the baby blanket of the present invention is such that the construction is relatively simple and inexpensive, but yet presents a new and useful baby blanket in accordance with the above specification.

The terms "upper", "lower", "forward", "rearward", etc., have been used herein merely for the convenience of the foregoing specification and in the appended Claims to describe the baby blanket and its parts as oriented in the drawings. It is to be understood, however, that these terms are in no way limiting to the invention since the baby blanket may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A baby blanket comprising: a generally rectangular cloth back having an outer border including four edges defining a first area within said border; and a baby receiving and holding compartment defined within said baby blanket by a generally triangularly shaped cloth enclosing panel secured adjacent to only a first portion of said back and extending thereacross; and wherein said enclosable panel has an area approximately one-half the area of said back and includes at least three edges with at least two edges being secured to said back by stitching leaving at least one edge unsecured relative to said back and open so as to define an entry to said baby compartment; and wherein said generally triangularly shaped enclosing panel is secured to said back such that the open unstitched edge thereof extends diagonally across said back between opposed corners thereof, with the two other remaining edges of said triangularly shaped enclosable panel being stitched to respective sides of said back.

2. The baby blanket of claim 1 wherein two storage compartments are provided as a part of said baby blanket, each storage compartment being formed on a respective side of said baby receiving and holding compartment.

3. The baby blanket of claim 1 wherein said baby receiving and holding compartment includes two side storage compartments formed by two laterally spaced parallely extending seams connecting said back with said enclosing panel and wherein said seams are spaced relative to said enclosing panels such that said baby receiving and holding compartment is disposed about the central area of said enclosing panel and said two storage compartments are disposed on respective sides thereof.

4. A baby blanket comprising: a rectangular cloth back having at least four edges; and a baby receiving and holding compartment defined about said baby blanket by a triangularly shaped enclosable cloth panel including three edges with two of said edges being secured to respective edges of said rectangular back and further including one unsecured edge that extends diagonally across substantially the entire back of said baby blanket between opposite corners thereof so as to define an entry to said baby receiving and holding compartment between said unsecured edge and said back; and wherein said enclosable cloth panel is of less area than said back but at least one-third the area thereof.

5. The baby blanket of claim 4 wherein a pair of storage compartments are formed about said baby blanket by a pair of laterally spaced parallel extending seams that connect said back with said enclosable panel and wherein said pair of seams are so spaced such that said baby receiving and holding compartments is centrally located between said back and said enclosable panel and wherein each respective storage compartment is defined about one side of said baby receiving and holding compartment.

* * * * *